US008079273B2

(12) United States Patent
Svenberg

(10) Patent No.: US 8,079,273 B2
(45) Date of Patent: Dec. 20, 2011

(54) POWER DETECTING DEVICE

(76) Inventor: Tomas Svenberg, Huskvarna (SE)

( * ) Notice: Subject to any disclaimer, the term of this patent is extended or adjusted under 35 U.S.C. 154(b) by 0 days.

(21) Appl. No.: 12/446,240

(22) PCT Filed: Oct. 10, 2007

(86) PCT No.: PCT/SE2007/000891
§ 371 (c)(1),
(2), (4) Date: Sep. 14, 2010

(87) PCT Pub. No.: WO2008/048161
PCT Pub. Date: Apr. 24, 2008

(65) Prior Publication Data

US 2011/0048141 A1 Mar. 3, 2011

(30) Foreign Application Priority Data

Oct. 20, 2006 (SE) ..... 0602212

(51) Int. Cl.
*G01L 3/00* (2006.01)

(52) U.S. Cl. ..... 73/862.08; 73/760

(58) Field of Classification Search ..... 73/760, 73/862.08, 862.11–862.13
See application file for complete search history.

(56) References Cited

U.S. PATENT DOCUMENTS

| | | | | |
|---|---|---|---|---|
| 4,141,248 | A | 2/1979 | Bergenda | |
| 4,625,551 | A | 12/1986 | Carnielli | |
| 4,674,741 | A * | 6/1987 | Pasierb et al. | 482/72 |
| 4,691,694 | A * | 9/1987 | Boyd et al. | 601/34 |
| 5,267,925 | A * | 12/1993 | Boyd | 482/64 |
| 6,027,429 | A * | 2/2000 | Daniels | 482/5 |
| 7,862,476 | B2 * | 1/2011 | Blau et al. | 482/8 |
| 2006/0079382 | A1 * | 4/2006 | Lassanske et al. | 482/63 |

OTHER PUBLICATIONS

International Search Report and Written Opinion of the ISA for corresponding International Application PCT/SE2007/000891.

* cited by examiner

*Primary Examiner* — Max Noori
(74) *Attorney, Agent, or Firm* — WRB-IP LLP

(57) ABSTRACT

A device for detecting power for exercise equipment has a wheel driven by a person exercising, a speedometer for determining the speed of rotation of the wheel and a brake jaw supported by a mounting device and applicable against the wheel. The mounting device is connected to the frame of the exercise equipment and has a moving part which supports the brake jaw and which, under the action of the braking force, is applicable against a resilient shoulder. The shoulder has a strain gauge for measuring elastic deformations in the shoulder and thereby also indirectly the size of the braking force.

20 Claims, 1 Drawing Sheet

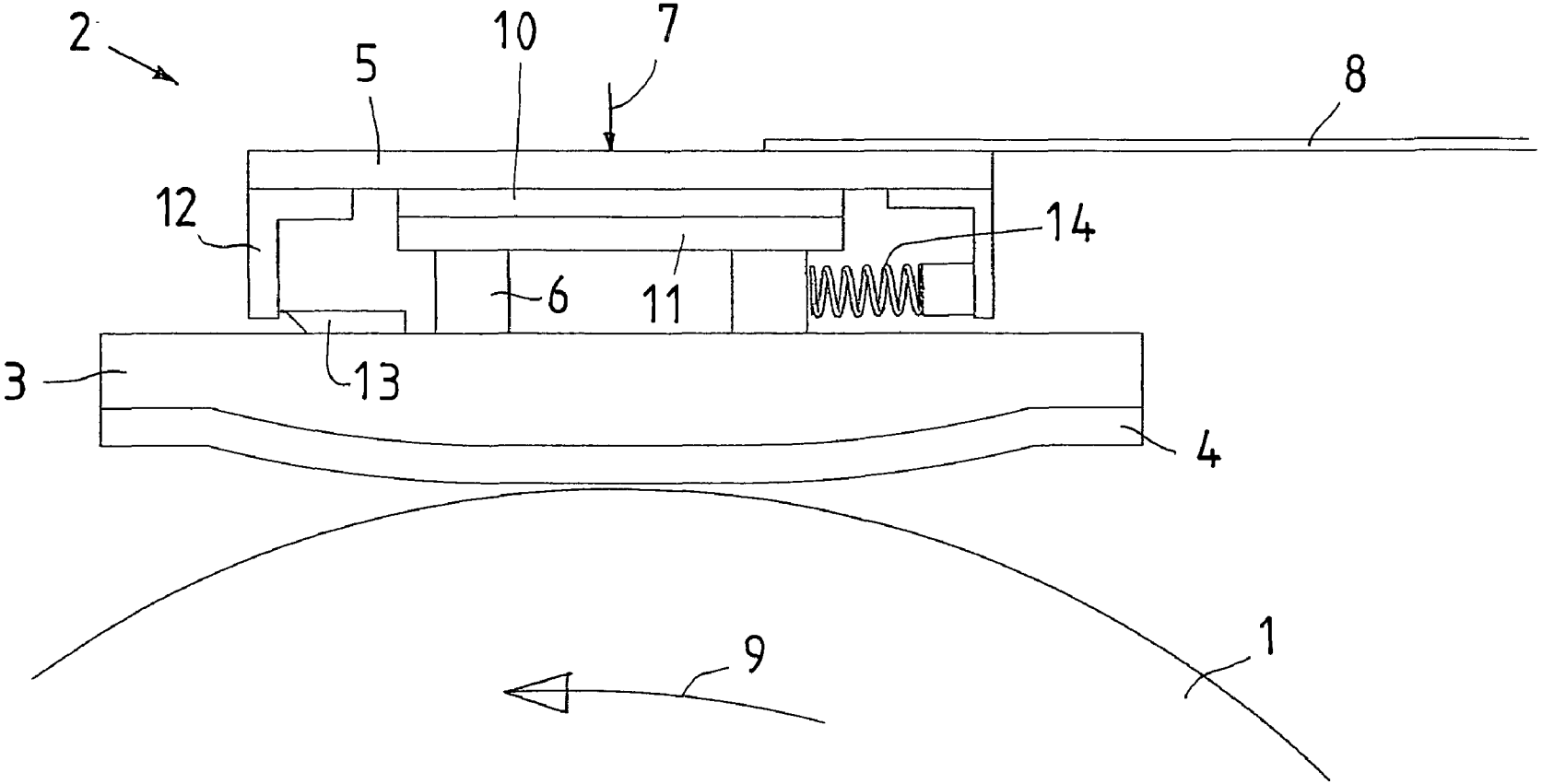
8
7
10
5
2
12
14
11
6
13
4
3
1
9

POWER DETECTING DEVICE

BACKGROUND AND SUMMARY

The present invention relates to a device for detecting developed power in exercise equipment, and comprising a rotary wheel drivable by a person taking exercise, a device for determining the speed of rotation of the wheel, a brake jaw applicable against the wheel, a mounting device with a first part which, in the direction of movement of the wheel, is fixedly secured in the exercise equipment, and a second part which, against spring action, is movable in the direction of movement of the wheel and to which the brake jaw is connected.

Exercise equipment with an ergonometer function is previously known in the art, one example of such is shown in EP 0 166 843 B1. This publication shows an ergonometer cycle, i.e. exercise equipment that measures the power of the work developed by the exercising person.

The ergonometer cycle according to EP 0 166 843 B1 has a flywheel that is driven in a rotary movement by the person using the ergonometer cycle. The cycle has a fork on which handlebars are secured which are concentric with the centre of rotation of the flywheel. Along these handlebars, an assembly with two pivotal brake jaws is displaceable and spring-biased against the direction of rotation of the flywheel. On application of the brake jaws against the peripheral surface of the flywheel, the braking force draws the assembly in the direction of rotation of the flywheel against spring force so that a displacement occurs. This displacement will be in response to the retardation force exercised on the flywheel. The greater the retardation or braking force, the greater will be this displacement.

The magnitude of the displacement is then transferred by the intermediary of a wire to a display instrument which also includes a speedometer indicating the speed of rotation of the flywheel.

In the above-described design and construction there are several different error sources. The reason for this is int. al. the considerable movement that the assembly with the brake jaws undergoes on use of the ergonometer cycle. Already minor defects in precision in the guiding that permits the movements of the assembly with the brake jaws result in loss of measurement accuracy. A further error source is the relatively great friction that may be expected in the wire which transfers the movement to the display unit. In addition, problems may occur because of wear in moving parts, insufficient lubrication thereof, etc.

It is desirable to design the device intimated by way of introduction such that the drawbacks inherent in the prior art technology are obviated. In particular, it is desirable to combine a high level of measurement accuracy with simple and economical manufacture. It is also desirable to design the device so that it operates without any major movements that may cause wear or varying geometry during operation.

In a device according to an aspect of the present invention, there is connected, to the first and second parts, a sensor for determining the movement of the second part in relation to the first in the direction of movement of the wheel.

DETAILED DESCRIPTION

The present invention will now be described in greater detail hereinbelow, with reference to the accompanying Drawing which schematically illustrates the subject matter of the present invention.

The present invention is based on the fact that the power developed by the person exercising is to be measured by a measurement of a "braked off" power caused by a brake. According to the invention, the force F that a brake device exercises against a flywheel driven by an exercising person is measured. If the radius R of the flywheel and its speed of rotation v are known, the power P will be $$P=RFv$$

speed of rotation of the flywheel may simply be measured with a high degree of accuracy, for example magnetically or optically. The radius of the flywheel may also be determined with high precision. In order to measure the retardation or brake force, as few moving parts as possible should be used, and those movements which are inevitable must be kept as small as possible.

In the accompanying Drawing, reference numeral 1 relates to a flywheel which may be set in rotation by the person using the subject matter of the present invention. The flywheel may, for example, be driven by the intermediary of chain or belt drive from a crank section fitted with pedals. The flywheel 1 is journalled, in a manner not shown in detail, in a frame for the exercise equipment. A brake device acts on the flywheel and the retardation or brake force of the brake device is adjustable and measurable.

The subject matter of the present invention further displays a meter for registering the speed of rotation at which the flywheel is caused to rotate.

In the FIGURE, reference numeral 2 relates to a mounting device included in the brake device and supporting a brake jaw 3 with a brake lining 4. The mounting device 2 has a first or fixed part 5 and a second or moving part 6.

The fixed part 5 of the mounting device 2 is fixedly secured, seen in the direction of movement of the flywheel, in the exercise equipment, i.e. it cannot move with or against the rotation of the flywheel 1. On the other hand, it is movable along a line extending through the centre of the flywheel 1 and a contact surface between the brake lining 4 and the flywheel 1. As a result, it will be movable at right angles to a tangent to the flywheel in the area of contact between the wheel and the brake lining.

The mounting device 2 is applicable against the flywheel 1 in the direction of the arrow 7, i.e. along the above-mentioned line through the centre of the flywheel, with the aid of a suitable adjustment device, for example a screw. This implies that, by means of an adjustment of the adjustment device (not shown on the Drawing), it is possible to vary the pressure between the brake lining 4 and the flywheel 1 and thereby the braking force exercised by the brake lining 4 against the flywheel 1.

The mounting device 2 is fixed in the exercise equipment with the aid of an arm 8 which may consist of or comprise spring steel, but which may also be rigid and pivotally secured in the exercise equipment so as to permit the insignificant movements that are required for urging of the brake jaw 3 in accordance with the arrow 7 against the flywheel 1

It will be apparent from the FIGURE that the surface of the brake lining 4 which is turned to face towards the flywheel 1 is convex outwards towards the flywheel, for example the surface may be a partly cylindrical surface. In that case when the arm 8 consists of or comprises resilient material, a braking force between the brake lining 4 and the flywheel 1 will act in a direction to the left, in other words with the rotation arrow 9. Such a braking force will exercise a flexural moment on the arm 8 so that this strives to flex outwards and downwards. Since the surface of the friction or brake lining 4 facing towards the flywheel 1 is arched, this will have as a result that the friction or brake lining "rolls" against the flywheel, for which reason no change of the size of the friction surface or its shape will take place, the geometry does not change.

The mounting device 2 includes a linear guide, preferably a ball guide, with an upper or fixed part which is connected to the underside of an upper anchorage plate which is included in the mounting device and in which the arm 8 is also secured. The linear ball guide further has a lower, movable part 11 which, possibly via intermediate pieces or spacers, is connected to the brake jaw 3. As a result, the brake jaw 3 will be displaceable in a direction right/left in the FIGURE and will be given an adequate guiding throughout the entire length of the ball guide. The friction is extremely slight and clearance or play is in principle non-existent.

It will be apparent from the foregoing that the application force which is represented by the arrow 7 will be transferred via the linear guide 10, 11 to the brake jaw 3 so that this can be applied against the flywheel 1.

The movements of the moving part 6 of the mounting device 2 take place along the direction of the arrow against a spring force which, in the illustrated embodiment, is realised by spring means in the form of a shoulder 12 which is secured in the fixed, upper mounting plate of the mounting device. The shoulder 12 functions a spring when its lower end is elastically urged in a direction to the left by a pressure device 13 which is fixedly united with the brake jaw 3. In such instance, the spring movements are extremely slight, possibly of the order of magnitude of 0.1 mm or less, and so no manifest movements take place during the operation. In order to ensure that the pressure device 13 is always urged against the shoulder 12, there is provided a spring 14 which, with its one end, urges the brake jaw 3 in a direction to the left and, with its opposite end, urges against an abutment secured in the fixed part 5 of the mounting device.

In order to measure that movement which is imparted to the brake jaw 3 because of the braking force against the above-mentioned spring action, use is made of a sensor which senses the relative movement between the second (moving) part 6 of the mounting device 2 and its first (fixed) part 5. In the embodiment under consideration here, the sensor comprises a strain gauge which is placed on the shoulder 12 in order to sense the extremely slight and elastic deformations which this undergoes under the action of the braking force applied via the pressure device 13

In alternative embodiments, a different spring means may be employed than the shoulder 12 and it is also possible to employ other types of sensors, for example capacitative sensors or linear potentiometers.

The shoulder 12 operates resiliently within its elastic range; hence such great braking forces that the plasticity limit of the shoulder is exceeded are out of the question.

Since the movement generated by the braking force in the direction of the arrow 9 is slight, the ball guide may possibly be replaced by an elastic suspension of the brake jaw in relation to the fixed part 5 of the mounting device 2, e.g. by an elastic body of plastic or rubber.

Regardless of what type of sensor which is employed, the output signal from this sensor will be representative of the braking force which the brake lining 4 exercises against the flywheel 1. Since the radius of the flywheel is known and moreover the present invention includes a speedometer which indicates the speed of rotation of the flywheel, a calculation can easily be made of the "braked off" loss of power.

What is claimed is:

1. A device for detecting developed power in exercise equipment, and comprising: a rotary wheel drivable by a person taking exercise, a device for determining a speed of rotation of the wheel, a brake jaw applicable against the wheel, a mounting device with a first part which, in a direction of movement of the wheel, is fixedly secured to the exercise equipment, and a second part which, against spring action, is movable in the direction of movement of the wheel and to which the brake jaw is connected, wherein there is connected, to the first and second parts, a sensor for determining a movement of the second part in relation to the first part in the direction of movement of the wheel.

2. The device as claimed in claim 1, wherein the mounting device includes a linear guide which is disposed to transfer to the brake jaw an application force against the wheel.

3. The device as claimed in claim 2, wherein there is disposed, on the first part of the mounting device, a yieldable shoulder against which a pressure device disposed on the second part is applicable, under the action of the braking force, and the sensor is disposed to measure elastic deformation in the shoulder.

4. The device as claimed in claim 3, wherein the mounting device is movable along a line which extends through the centre of the wheel and the abutment surface of the brake jaw against the wheel; and the mounting device is urgeable against the wheel along the line.

5. The device as claimed in claim 4, wherein the first part of the mounting device is connected to the exercise equipment by the intermediary of a resilient arm whose longitudinal direction is substantially parallel with a tangent to the wheel in the area of the abutment of the brake jaw thereagainst.

6. The device as claimed in claim 3, wherein the mounting device includes a spring which is disposed to hold the pressure device against the shoulder.

7. The device as claimed in claim 2, wherein the brake jaw has a brake surface intended for abutment against the periphery of the wheel and which is convex to the wheel.

8. The device as claimed in claim 3, wherein the sensor is a strain gauge disposed on the shoulder.

9. The device as claimed in claim 2, wherein the linear guide is a linear ball bearing.

10. A device for detecting developed power in exercise equipment, and comprising: a rotary wheel drivable by a person taking exercise, a device for determining a speed of rotation of the wheel, a brake jaw applicable against the wheel, a mounting device with a first part which, in a direction of movement of the wheel, is fixedly secured to the exercise equipment, and a second part which, against spring action, is movable in the direction of movement of the wheel and to which the brake jaw is connected, wherein there is connected, to the first and second parts a sensor for determining a movement of the second part in relation to the first part in the direction of movement of the wheel, wherein the mounting device includes a linear guide which is disposed to transfer to the brake jaw an application force against the wheel, wherein the linear guide is a body of elastic material.

11. A device for detecting developed power in exercise equipment, and comprising: a rotary wheel drivable by a person taking exercise, a device for determining, a speed of rotation of the wheel, a brake jaw applicable against the wheel a mounting device with a first part which, in a direction of movement of the wheel, is fixedly secured to the exercise equipment, and a second part which, against spring action, is movable in the direction of movement of the wheel and to which the brake jaw is connected wherein there is connected, to the first and second parts, a sensor for determining a movement of the second part in relation to the first part in the direction of movement of the wheel, wherein there is disposed, on the first part of the mounting device, a yieldable shoulder against which a pressure device disposed on the second part is applicable, under the action of the braking force, and the sensor is disposed to measure the elastic deformation in the shoulder.

12. The device as claimed in claim 11, wherein the mounting device is movable along a line which extends through the centre of the wheel and the abutment surface of the brake jaw against the wheel; and the mounting device is urgeable against the wheel along the line.

13. The device as claimed in claim 12, wherein the first part of the mounting device is connected to the exercise equipment by the intermediary of a resilient arm whose longitudinal direction is substantially parallel with a tangent to the wheel in the area of the abutment of the brake jaw thereagainst.

14. The device as claimed in claim 11, wherein the mounting device includes a spring which is disposed to hold the pressure device against the shoulder.

15. The device as claimed in claim 1, wherein the brake jaw has a brake surface intended for abutment against the periphery of the wheel and which is convex to the wheel.

16. The device as claimed in claim 11, wherein the sensor is a strain gauge disposed on the shoulder.

17. The device as claimed in claim 3, wherein the linear guide is a linear ball bearing.

18. A device for detecting developed power in exercise equipment, and comprising: a rotary wheel drivable by a person taking exercise a device for determining a speed of rotation of the wheel, a brake jaw applicable against the wheel, a mounting device with a first part which, in a direction of movement of the wheel, is fixedly secured to the exercise equipment, and a second part which, against spring action, is movable in the direction of movement of the wheel and to which the brake jaw is connected, wherein there is connected to the first and second parts a sensor for determining a movement of the second part in relation to the first part in the direction of movement of the wheel, wherein the mounting device includes a linear guide which is disposed to transfer to the brake jaw an application force against the wheel, wherein there is disposed on the first part of the mounting device, a yieldable shoulder against which a pressure device disposed on the second part is applicable, under the action of the braking force and the sensor is disposed to measure the elastic deformation in the shoulder, wherein the linear guide is a body of elastic material.

19. A device for detecting developed power in exercise equipment, comprising:

a rotary wheel drivable by a person taking exercise, a device for determining a speed of rotation of the wheel;

a brake jaw applicable against the wheel; and a mounting device with a first part which, in a direction of movement of the wheel, is fixedly secured to the exercise equipment, and a second part which, against spring action, is movable in the direction of movement of the wheel and to which the brake jaw is connected, wherein there is connected, to the first and second parts, a sensor for determining a movement of the second part in relation to the first part in the direction of movement of the wheel and wherein the mounting device includes a linear guide which is disposed to transfer to the brake jaw an application force against the wheel and to allow linear movements between the first and second parts.

20. A device for detecting developed power in exercise equipment, comprising:

a rotary wheel drivable by a person taking exercise;

a device for determining a speed of rotation of the wheel;

a brake jaw applicable against the wheel; and a mounting device which connects the brake jaw to a frame of the equipment, wherein the mounting device comprises an elastic material permitting movement of the brake jaw in a direction of rotation of the wheel.

* * * * *